US008752689B2

(12) United States Patent
Kagoshima et al.

(10) Patent No.: US 8,752,689 B2
(45) Date of Patent: Jun. 17, 2014

(54) MONEY INPUT/OUTPUT APPARATUS, REPLENISHING/COLLECTING APPARATUS, AND METHOD OF RUNNING MONEY INPUT/OUTPUT APPARATUS

(71) Applicant: Fujitsu Frontech Limited, Tokyo (JP)

(72) Inventors: Kazuhiro Kagoshima, Tokyo (JP); Ryosuke Ebinuma, Tokyo (JP)

(73) Assignee: Fujitsu Frontech Limited, Tokyo (JP)

( * ) Notice: Subject to any disclaimer, the term of this patent is extended or adjusted under 35 U.S.C. 154(b) by 0 days.

(21) Appl. No.: 13/902,213

(22) Filed: May 24, 2013

(65) Prior Publication Data

US 2013/0256091 A1 Oct. 3, 2013

Related U.S. Application Data

(63) Continuation of application No. PCT/JP2010/073725, filed on Dec. 28, 2010.

(51) Int. Cl.
*G07F 7/04* (2006.01)

(52) U.S. Cl.
USPC ..... 194/206

(58) Field of Classification Search
USPC ..... 194/206, 350; 209/534; 235/379; 700/215, 221, 224, 225, 226
See application file for complete search history.

(56) References Cited

U.S. PATENT DOCUMENTS

| | | | | |
|---|---|---|---|---|
| 7,000,778 | B2 * | 2/2006 | Omori et al. | 209/534 |
| 8,172,131 | B2 * | 5/2012 | Langlotz et al. | 235/379 |
| 2005/0273474 | A1 | 12/2005 | Kawamura et al. | |
| 2006/0004877 | A1 | 1/2006 | Ishikawa et al. | |
| 2008/0256137 | A1 | 10/2008 | Kawamura et al. | |
| 2009/0212493 | A1 | 8/2009 | Sugahara et al. | |
| 2010/0168903 | A1 * | 7/2010 | Aas et al. | 700/214 |

FOREIGN PATENT DOCUMENTS

| | | |
|---|---|---|
| EP | 0 540 867 A2 | 9/1992 |
| JP | 5-266299 | 10/1993 |
| JP | 10-269396 | 10/1998 |
| JP | 2006-18798 | 1/2006 |
| JP | 2006-260078 | 9/2006 |
| JP | 2008-262389 | 10/2008 |
| JP | 2009-048664 | 3/2009 |
| JP | 2009-205252 | 9/2009 |

OTHER PUBLICATIONS

Int'l. Search Report issued in Int'l. App. No. PCT/JP2010/073725, mailed Apr. 26, 2011.

* cited by examiner

*Primary Examiner* — Mark Beauchaine
(74) *Attorney, Agent, or Firm* — Greer Burns & Crain Ltd.

(57) ABSTRACT

A money input/output apparatus includes a bill accommodation unit, a mount unit, a detection unit, a second storage unit, an instruction reception unit, a conveyance unit, and a control unit. The control unit reads the denomination of the bill from the first storage unit and determines whether or not the read denomination of the bill corresponds to the denomination stored in the second storage unit in association with the mount unit on which mounting of the bill accommodation unit has been detected when the detection unit has detected that the bill accommodation unit has been mounted on the mount unit, starts reception of an instruction to input or output to the bill from the instruction receiving unit and makes the conveyance unit convey the bill in accordance with the instruction when the denominations have been determined to correspond. Thereby, a bill accommodation unit can be used for all denominations.

10 Claims, 12 Drawing Sheets

MONEY INPUT/OUTPUT APPARATUS, REPLENISHING/COLLECTING APPARATUS, AND METHOD OF RUNNING MONEY INPUT/OUTPUT APPARATUS

CROSS-REFERENCE TO RELATED APPLICATION

This application is a continuation application of International Application PCT/JP2010/073725 filed on Dec. 28, 2010 and designated the U.S., the entire contents of which are incorporated herein by reference.

FIELD

The present invention relates to a money input/output apparatus, a replenishing/collecting apparatus, and a method of running a money input/output apparatus.

BACKGROUND

When, for example, a ticket vending machine or the like for vending tickets has received a bill, it examines the bill for the authenticity, the denomination, the degree of damage, etc., and stores bills that can be output as change for each denomination. These bills are stacked, accumulated, and stored (see Patent Document 1, for example).

Also, some automated teller machines, or the like used in banking facilities are provided with a temporary depository having functions of sequentially accommodating bills which have been input and whose denominations have been determined, holding them until the transaction is completed, and sequentially releasing those bills after the transaction is completed. This temporary depository is provided with a rotatable drum to roll up bills together with tape, and the rotatable drum is rotated in one direction so that it rolls up bills on itself to hold the bill temporarily, and then it is rotated in the reverse direction so as to discharge the rolled up bills (see Patent Document 2, for example).

Further, an example has also been disclosed in which an accommodation unit for accommodating a plurality of denominations of bills separately is provided with a drum that can rotate in forward and backward directions in order to roll up a bill by having the bill between two pieces of tape (see Patent Document 3, for example).

Patent Document 1 (Japanese Laid-open Patent Publication No. 2009-205252)

Patent Document 2 (Japanese Laid-open Patent Publication No. 2009-48664)

Patent Document 3 (Japanese Laid-open Patent Publication No. 2006-260078)

SUMMARY

A money input/output apparatus according to one aspect of the present invention is a money input/output apparatus that inputs and outputs a bill including a removable bill accommodation unit that can accommodate at least one denomination of a bill, includes a first storage unit storing accommodation information including a denomination of an accommodated bill, and accommodates and discharges a bill, a mount unit on which the bill accommodation unit is mounted, a detection unit that detects whether or not the bill accommodation unit has been mounted on the mount unit, a reading unit that reads the denomination of the bill from the first storage unit when the detection unit has detected mounting of the bill accommodation unit, a second storage unit that stores the mount unit and the denomination of the bill to be accommodated in the bill accommodation unit mounted on the mount unit in an associated manner, an accommodation determination unit that determines whether or not the denomination of the bill read by the reading unit corresponds to the denomination stored in the second storage unit in association with the mount unit on which the mounting of the bill accommodation unit has been detected, an instruction receiving unit that starts reception of an instruction to input or output the bill when the accommodation determination unit has determined that the denominations correspond, and a conveyance unit that conveys the bill in accordance with the instruction.

A money input/output apparatus according to another aspect includes a removable bill accommodation unit that can accommodate at least one denomination of a bill, includes a first storage unit storing accommodation information including a denomination of an accommodated bill, and accommodates and discharges a bill, amount unit on which the bill accommodation unit is mounted, a detection unit that detects whether or not the bill accommodation unit has been mounted on the mount unit, a reading unit that reads the denomination of the bill from the first storage unit when the detection unit has detected mounting of the bill accommodation unit, a second storage unit that stores the denomination read by the reading unit and the mount unit in an associated manner, an instruction receiving unit that starts reception of an instruction to input or output the bill when the denomination and the mount unit are stored in the second storage unit in an associated manner, and a conveyance unit that conveys the bill in accordance with information in the second storage unit and the instruction.

A bill replenishing/collecting apparatus according to another aspect includes a removable bill accommodation unit that can accommodate at least one denomination of a bill, includes a first storage unit storing accommodation information including a denomination and a number of an accommodated bill, and accommodates and discharges a bill, a mount unit on which the bill accommodation unit is mounted, a detection unit that detects whether or not the bill accommodation unit has been mounted on the mount unit, a replenishment instruction obtainment unit that obtains a replenishment instruction including a denomination and a number of bills with which the bill accommodation unit is replenished when the detection unit has detected the mounting of the bill accommodation unit, a replenishment unit that replenishes the bill accommodation unit with bills in accordance with the replenishment instruction, a bill distinguishing unit that determines a denomination and a number of the bills used for the replenishment in accordance with the replenishment instruction, a recording unit that records the accommodation information in the first storage unit in accordance with the denomination and the number of the bills determined by the bill distinguishing unit.

A method of running a money input/output apparatus according to another aspect is a method of running a money input/output apparatus that inputs and outputs a bill, including a detecting step in which a detection unit provided in the money input/output apparatus detects whether or not a bill accommodation unit that can accommodate at least one denomination of a bill, includes a first storage unit storing accommodation information including a denomination of an accommodated bill, can be mounted on and removed from a mount unit included in the money input/output apparatus, and accommodates and discharges a bill has been mounted on the mount unit, a reading step of reading a denomination of the bill from the first storage unit, an accommodation unit determination step of determining whether or not the denomination read in the reading step corresponds to a denomination stored in a second storage unit in the input/output apparatus in association with the mount unit on which the mounting of the bill accommodation unit has been detected, an instruction receiving step of starting reception of an instruction to input or output the bill when the denominations have been determined to correspond in the accommodation unit determination step, and a conveyance step of conveying the bill in accordance with the instruction.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

As described in, for example, Patent Document 1, bills that are accommodated in a stacked and accumulated state for use as change sometimes cause conveyance failures such as double feed, or the like during feed-out operations. Also, double feed sometimes causes errors in counting the number of bills. Due to this, a feed-out mechanism that manages friction or gap has to be provided to the bill feed out unit of a bill accommodation unit. For this, dedicated accommodation units and feed out units that have been adjusted to the sizes of respective bills have to be prepared, and changes of denominations to be treated requires mechanical adjustments, making each of these units unable to respond to different sized bills, which is problematic.

Meanwhile, as described in Patent Documents 2 and 3, a unit can be used in common for different sized bills according to a method in which a bill is rolled up on a drum together with tape, and is accommodated. However, according to a method in which bills are rolled up on a drum to be accommodated, when an accommodation unit is replenished with bills to be used as change or accommodated bills are collected, bills have to be accommodated or discharged sequentially. Due to this, operations take time before the service starts and after the service is finished, which is problematic. Also, when an accommodation unit has to be replenished with bills or bills have to be collected during service hours in banking facilities, or the like, the replenishing or collecting operations have to suspend the service for not a short time period, which deteriorates the quality of customer services.

First Embodiment

Figure 1:
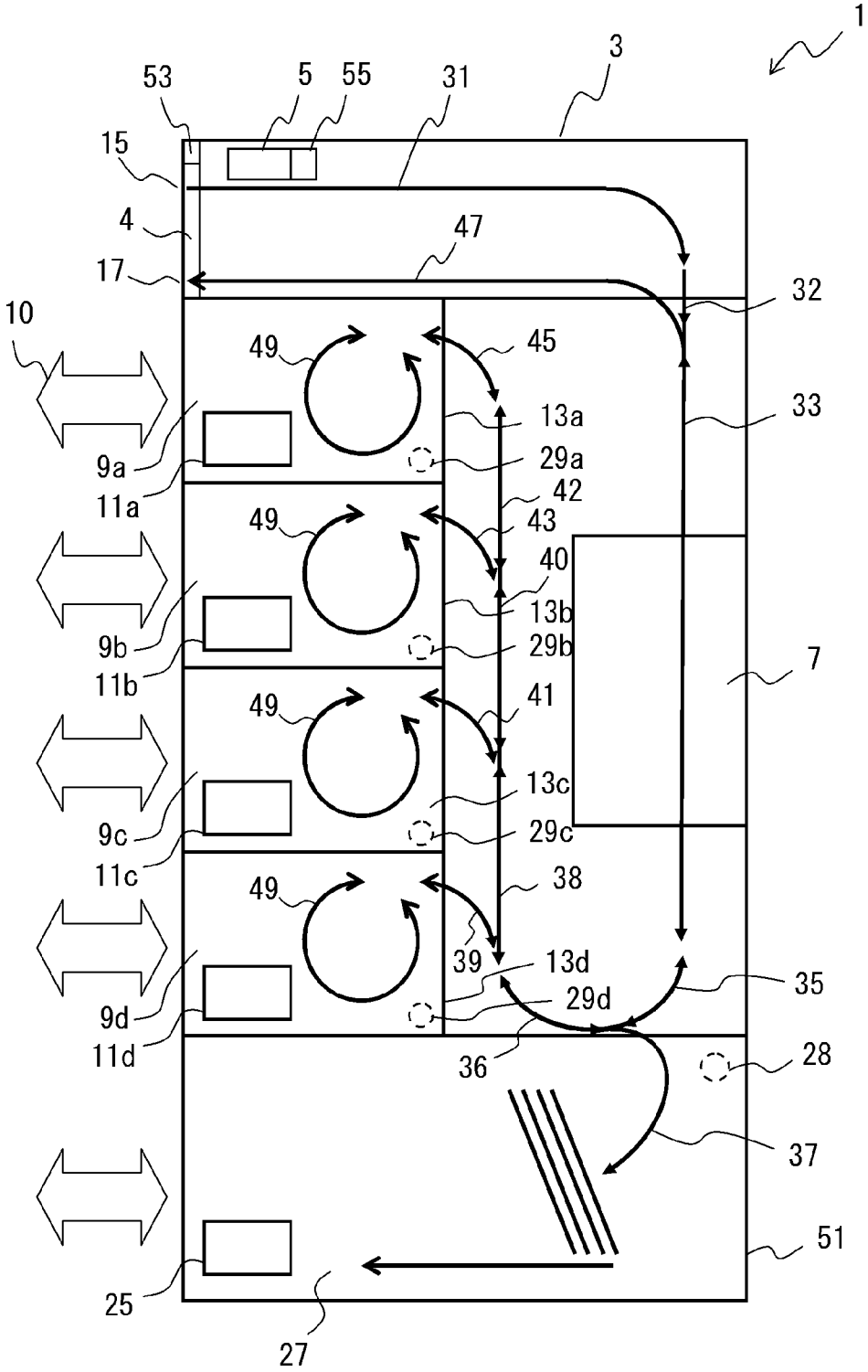
FIG. 1 is a configuration of a money input/output apparatus according to a first embodiment.
Figure 2:
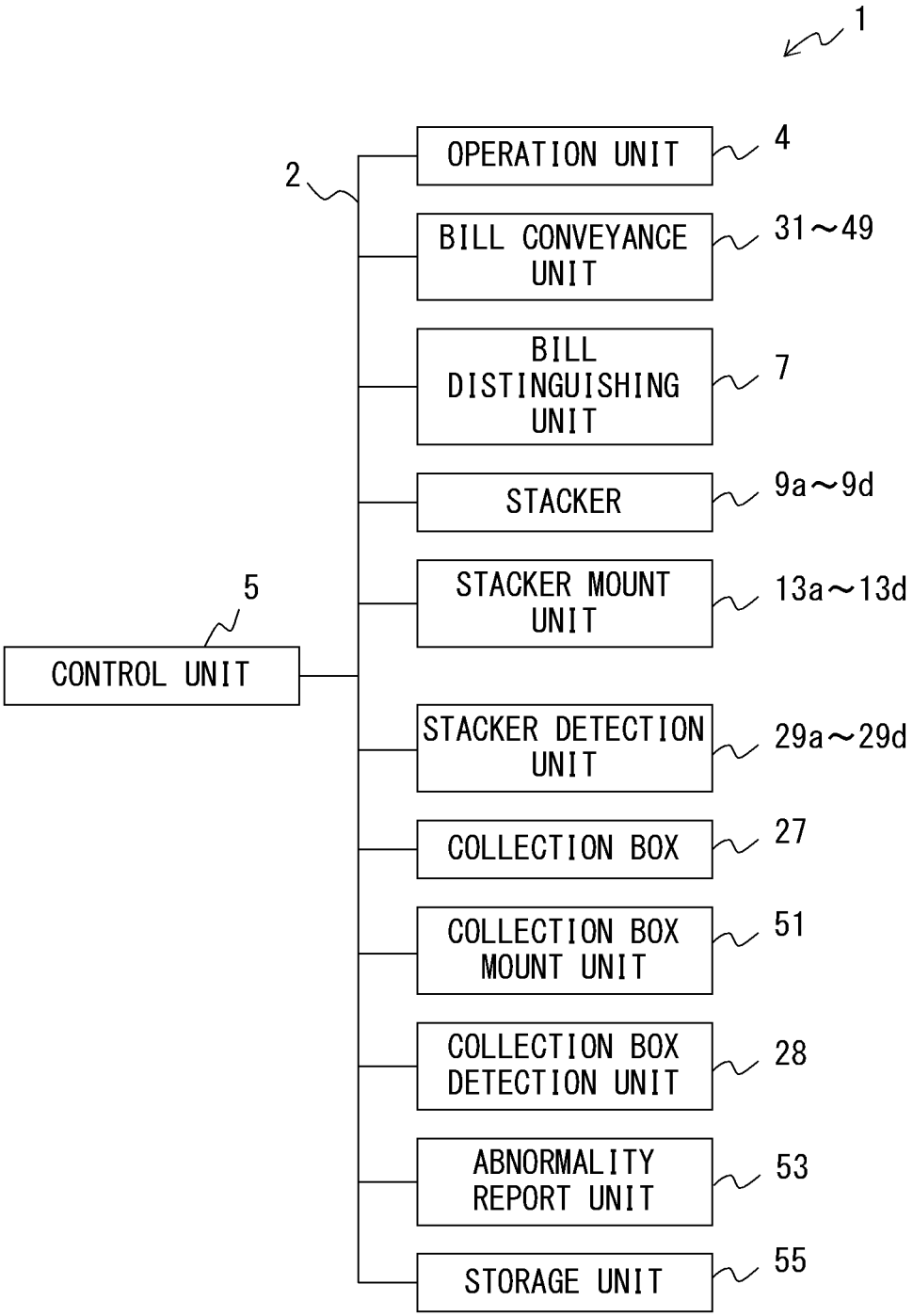
FIG. 2 is a block diagram representing a configuration of the money input/output apparatus according to the first embodiment.
Figure 3:
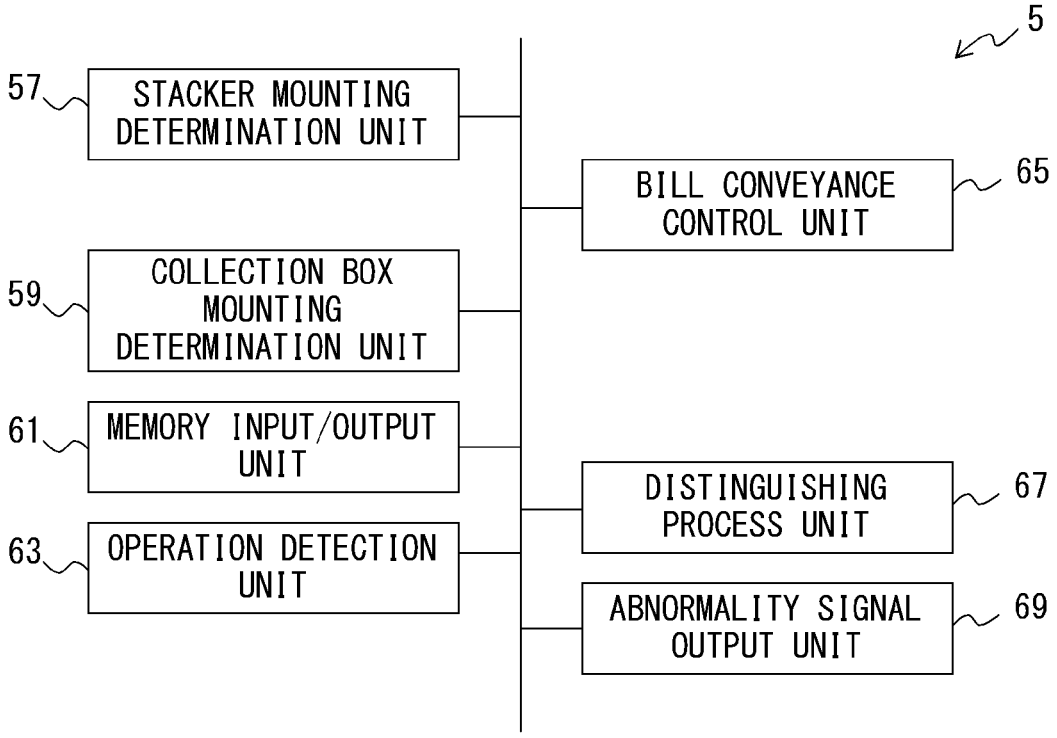
FIG. 3 is a block diagram representing functions of a control unit of the money input/output apparatus according to the first embodiment.

Hereinafter, the embodiments of the present invention will be explained by referring to the drawings. First, explanations will be given for the configuration of a money input/output apparatus 1 according to a first embodiment by referring to FIGS. 1 through 3. FIG. 1 is a configuration of the money input/output apparatus 1 according to the first embodiment. FIG. 2 is a block diagram representing the configuration of the money input/output apparatus 1. FIG. 3 is a block diagram representing functions of a control unit of the money input/output apparatus 1.

As represented in FIGS. 1 and 2, the money input/output apparatus 1 is a money input/output apparatus that can be used as a money input/output unit of, for example, automated teller machines in banking facilities, ticket vending machines for transport facilities, etc. The money input/output apparatus 1 includes an operation unit 4, bill conveyance units 31 through 49, a bill distinguishing unit 7, stackers 9*a* through 9*d* (referred to also as stacker 9), stacker mount units 13*a* through 13*d* (referred to also as mount unit 13), stacker detection units 29*a* through 29*d* (referred to also as stacker detection unit 29), a collection box 27, a collection box mount unit 51, a collection box detection unit 28, an abnormality report unit 53, and a storage unit 55, which are connected to a control unit 5 through a system bus 2.

The operation unit 4 includes an input display unit (not shown) that is set, for example, on the front plane of the money input/output apparatus 1 so as to receive instructions such as purchases of tickets, deposit or withdrawal of cash, a money input unit 15 through which bills are inserted, and a money output unit 17 for discharging bills as change or money being paid back. Explanations will be given for an implementation in which the operation unit 4 is provided directly to the money input/output apparatus 1 for convenience. However, when the operation unit 4 is used as the money input/output unit of an automated teller machine or the like, it may be provided to the main body unit of an automated teller machine so as to be electrically connected to the money input/output apparatus 1.

The bill conveyance units 31 through 49 are paths along which a plurality of rollers (not shown) that can rotate in the forward and backward directions are provided for conveying bills to a prescribed direction by holding bills between themselves, using friction or by other means. The bill conveyance units 31 through 49 are further provided with a motor (not shown) for driving at least part of these plurality of rollers so that bills can be conveyed between the money input unit 15, the stacker 9, the collection box 27, and the money output unit 17 bidirectionally. The bill conveyance unit 49 will be explained later in detail. The bill distinguishing unit 7 is a distinguishing device for determining the denominations, the authenticity, etc. of bills. Bills are distinguished both when they are input and output, however, they may be distinguished in a simplified manner such as by determining only the lengths of bills when, for example, they are output.

The stackers 9*a* through 9*d* are removably provided to the stacker mount units 13*a* through 13*d*, respectively as indicated by arrows 10 in FIG. 1 so as to be able to accommodate bills inside themselves and to feed out the bills to the outside. The stacker 9 may be mounted on any stacker mount units 13, and has the same internal configurations as the other stackers 9. For example, the stacker 9*a*, the stacker 9*b*, and the stacker 9*c* can accommodate 10000 yen bills, 5000 yen bills, and 1000 yen bills, respectively, whereas they have the same internal configurations. The stacker 9 can also be used as, for example, a temporary depository for temporarily storing bills input from the money input unit 15 after the start of an operation through the operation unit 4 until the process started by that operation finishes. The configurations of the stackers 9*a* through 9*d* will be explained later in detail.

Each of the stackers 9 includes a memory device 11. The memory devices 11 are rewritable memory devices, and store as accommodation information at least the denominations and the numbers of bills accommodated in the stacker 9 in such a manner that the denominations and the numbers are associated. It is also possible to store as accommodation information the categories of bills, date of accommodation, and identification information of the money input/output apparatus 1 that was used previously. Categories of bills are, for example, whether or not each bill is authentic, damaged, suspicious about the authenticity, or counterfeit. Also, when, for example, the stacker 9 is used as a temporary depository for storing input bills temporarily, information reporting that fact may be stored.

The stacker detection unit 29 is, for example, an optical sensor, and is configured to cover the light receiving unit when the stackers 9*a* through 9*d* are mounted so that it outputs to the control unit 5 signals in accordance with whether stackers 9*a* through 9*d* have been mounted on the money input/output apparatus 1.

The collection box 27 is an accommodation unit for accommodating bills that have been determined to be not necessary to be accommodated in the stacker 9 because at least one of the stackers 9*a* through 9*d* has already accommodated sufficient number of bills, bills left behind in the money output unit 17, bills that have been determined by the bill distinguishing unit 7 to be inappropriate as bills to be output (such as in cases when there are breakages, damages, stains, or the like), bills that will not be used as change (high denomination bills), etc., and is removably provided to the collection box mount unit 51. Also, the collection box 27 accommodates bills fed out from the stackers 9*a* through 9*d* when bills are collected without removing the stackers 9*a* through 9*d*. It is also possible for the operation unit 4 to instruct the collection box to accommodate bills that have been accommodated in the stackers even when the stackers can accommodate more bills.

The collection box 27 includes a memory device 25. The memory device 25 is a rewritable memory device, and stores as accommodation information at least the denominations, the numbers, the categories, and etc. of bills accommodated in such a manner that the denominations, the numbers, the categories, and etc. are associated. The memory device 25 may also store the dates of accommodating the bills, the identification information of the money input/output apparatus 1 that was used previously, and the like. The collection box detection unit 28 is, for example, an optical sensor, and is configured to cover the light receiving unit when the collection box 27 is mounted and to receive light when the collection box 27 is not mounted so that it outputs to the control unit 5 signals in accordance with whether the collection box 27 has been mounted on the money input/output apparatus 1.

The abnormality report unit 53 uses, for example, light, sound, etc. in order to report an abnormality to the stacker mount unit 13 when an abnormality has occurred such as in a case where the stacker 9 not set in the control unit 5 has been mounted, a case where a conveyance abnormality has been detected, or other cases. The storage unit 55 is a ROM (Read Only Memory) device, a RAM (Random Access Memory) device, or the like for appropriately recording a control program of the money input/output apparatus 1, setting of denominations corresponding to the stackers 9*a* through 9*d*, data related to the conveyance of bills, data read from the memory devices 11 provided to the stackers 9*a* through 9*d*, information generated accompanying processes by the control unit 5 such as distinguishing results, or the like. The above configuration recycles various types of bills in the money input/output apparatus 1 according to the present embodiment.

Explanations will be given for functions of the control unit 5 by referring to FIG. 3. The control unit 5 has the functions of a stacker mounting determination unit 57, a collection box mounting determination unit 59, a memory input/output unit 61, an operation detection unit 63, a bill conveyance control unit 65, a distinguishing process unit 67, an abnormality signal output unit 69. The stacker mounting determination unit 57 determines whether or not the stackers have been mounted on the stacker mount units 13*a* through 13*d* in accordance with signals output from the stacker detection unit 29. The collection box mounting determination unit 59 determines whether or not the collection box 27 has been mounted on the collection box mount unit 51 in accordance with signals output from the collection box detection unit 28.

The memory input/output unit 61 reads and writes data to the memory device 11 included in the stacker 9 and the memory device 25 included in the collection box 27, and stores read data in the storage unit 55. The operation detection unit 63 detects operation made on the operation unit 4. The bill conveyance control unit 65 controls the conveyance of bills by the bill conveyance unit and the stackers 9*a* through 9*d* in accordance with operations made on the operation unit 4, data read from the memory device 11, a control program stored in the storage unit 55, and the like. The distinguishing process unit 67 detects the denominations, authenticity, or the like of bills in accordance with information on the bills detected by the bill distinguishing unit 7 so as to distinguish the bills, and stores the distinguishing results in the storage unit 55. When an abnormality has been detected in the money input/output apparatus 1, the abnormality signal output unit 69 outputs a signal to report the abnormality to the abnormality report unit 53.

Figure 4:
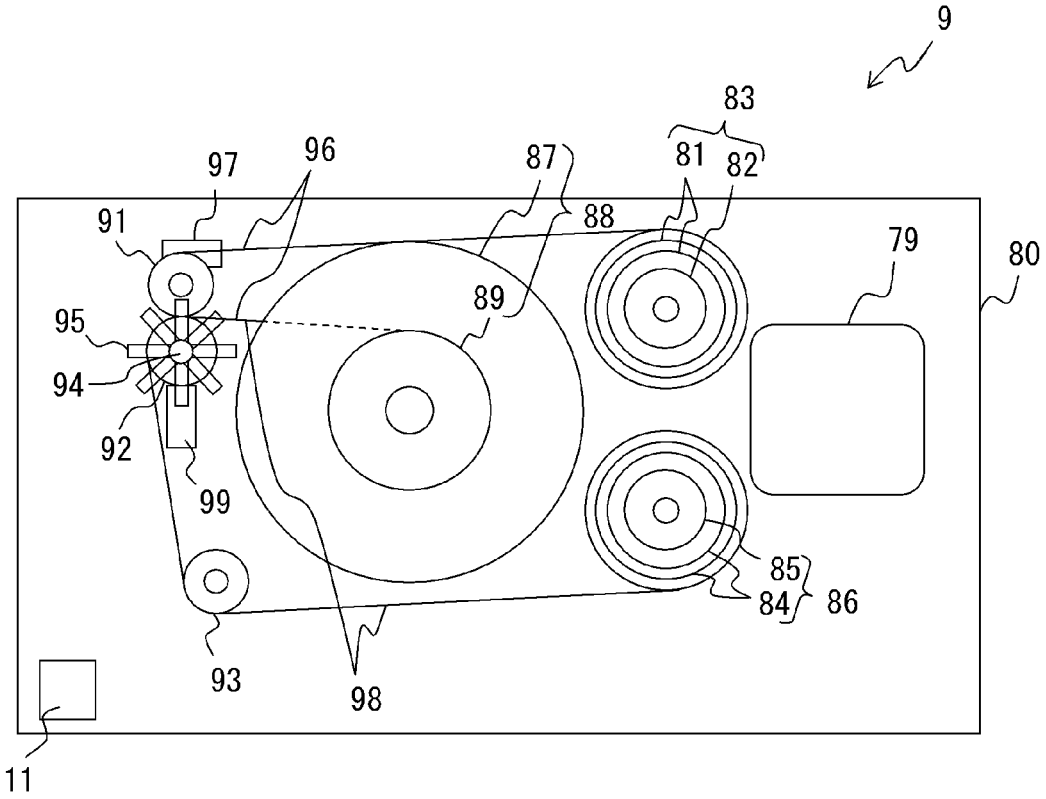
FIG. 4 is an internal configuration of a stacker according to the first embodiment.

Explanations will now be given for the internal configuration of the stacker 9 by referring to FIG. 4. FIG. 4 represents the internal configuration of the stackers. As illustrated in FIG. 4, the stacker 9 is provided with a drum 88 including a roll-up shaft 89 that has a manual knob 87. Pieces of tape 96 and 98 are fixed to the roll-up shaft 89 of the drum 88 at one end of each of them. The tape 96 and the tape 98 are belt-like films. The tape 96 is tensioned on a tension roller 91, and the other end of it is held by a holding roller 83. The holding roller 83 includes a torsion spring 21 and a torque limiter 22. The tape 96 is fed out from the holding roller 83, or is fed into the holding roller 83. At the same time, the tape 96 is rolled up on the drum 88, or is fed out from the drum 88.

The tape 98 is tensioned across the rotation transmission roller 92 and a guide roller 93, and the other end of it is held by a holding roller 86. The holding roller 86 includes a torsion spring 84 and a torque limiter 85. The tape 98 is fed out from the holding roller 86, or is fed into the holding roller 86. As the same time, the tape 98 is rolled up on the drum 88, or is fed out from the drum 88.

In the vicinity of the tension roller 91, a bill detection sensor 97 is arranged for detecting passing of bills, and transmits a detection signal to the control unit 5 when the stacker 9 is mounted on the money input/output apparatus 1. In this situation, it is desirable that the tape 96 be transparent or semi transparent because the bill detection sensor 97 detects bills through the tape 96.

Rotation detection plates 95 are provided in such a manner that they can rotate in synchronization with the rotation transmission roller 92 while being fixed to a rotation shaft 94 of the rotation transmission roller 92. A rotation sensor 99 is provided in such a manner that it loosely holds one of the rotation detection plates 95. In a state where the stacker 9 is mounted on the money input/output apparatus 1, the sensor 99 transmits to the control unit 5 a signal corresponding to the rotation speed of the rotation transmission roller 92.

Further, the stacker 9 has a stepping motor 79 for rotating the holding rollers 83 and 86, the rotation transmission roller 92, and the drum 88 both in the forward and backward directions via a gear or the like (not shown) in a state where the stacker 9 is mounted on the money input/output apparatus 1. The stepping motor 79 is controlled by the control unit 5 in accordance with signals from the bill detection sensor 97 and the rotation sensor 99.

In the above configuration, a bill that is being conveyed while being between the tension roller 91 and the rotation transmission roller 92 in the stacker 9 is rolled up on the roll-up shaft 89 of the drum 88 while being sandwiched by the tape 96 and the tape 98. Also, a bill that has been fed out from the drum 88 is fed to the outside from between the tension roller 91 and the rotation transmission roller 92 in a state that it is sandwiched by the tape 96 and the tape 98. Note that the bill conveyance unit in the stacker 9 that has been described above is shown as the bill conveyance unit 49 in FIG. 1 in a simplified manner.

Figure 5:
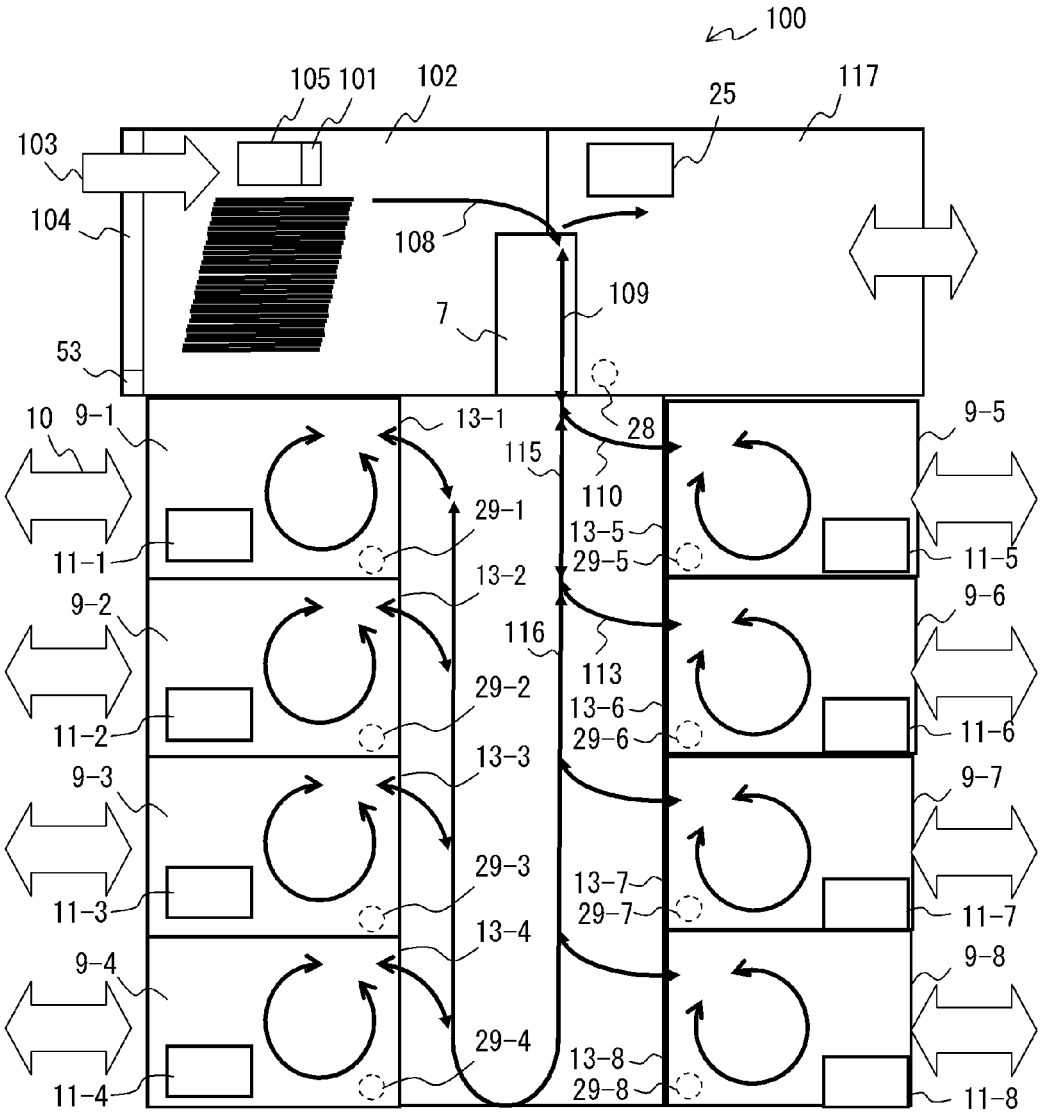
FIG. 5 is a configuration of a replenishing/collecting apparatus according to the first embodiment.
Figure 6:
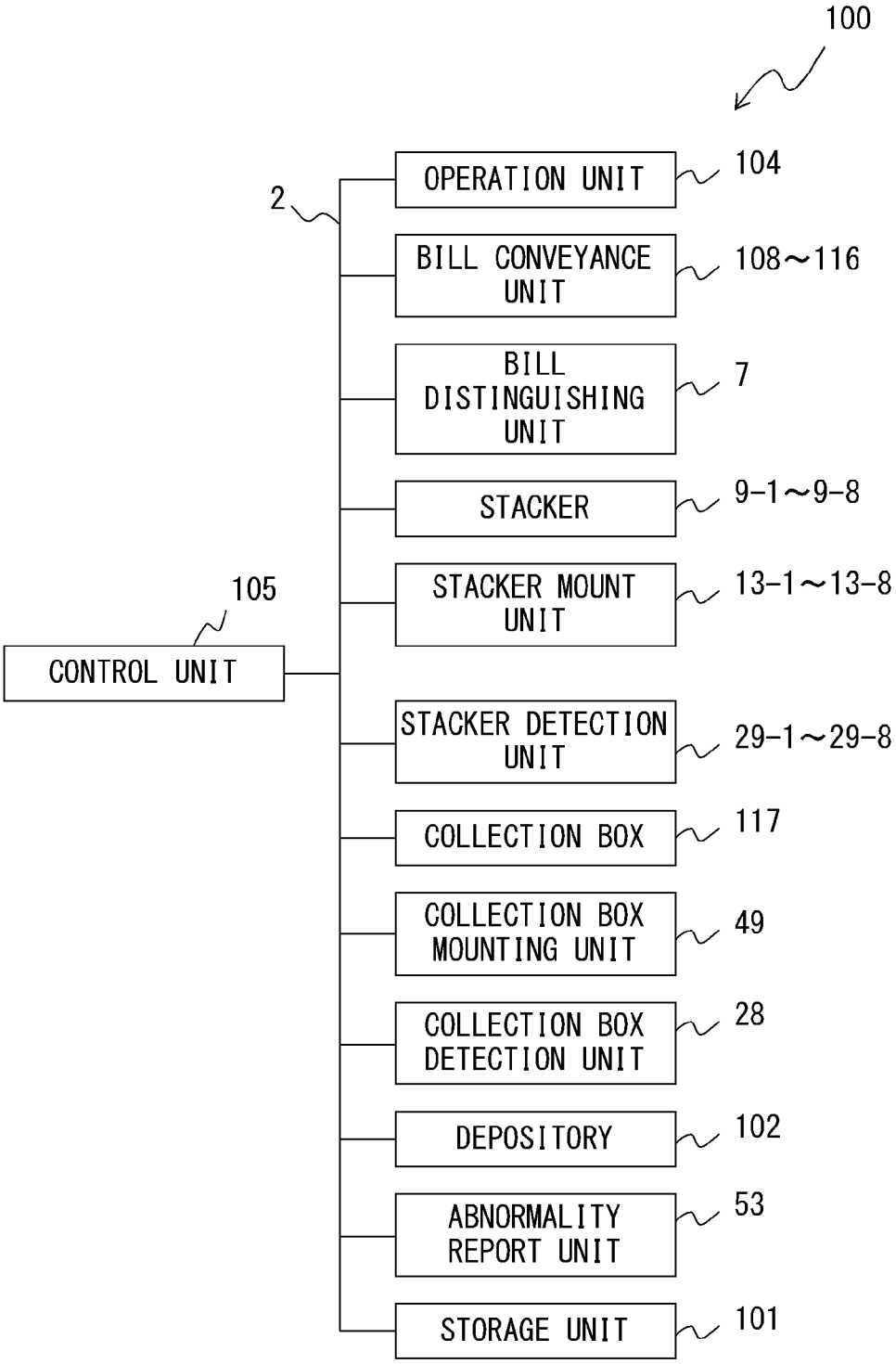
FIG. 6 is a block diagram representing a configuration of the replenishing/collecting apparatus according to the first embodiment.
Figure 7:
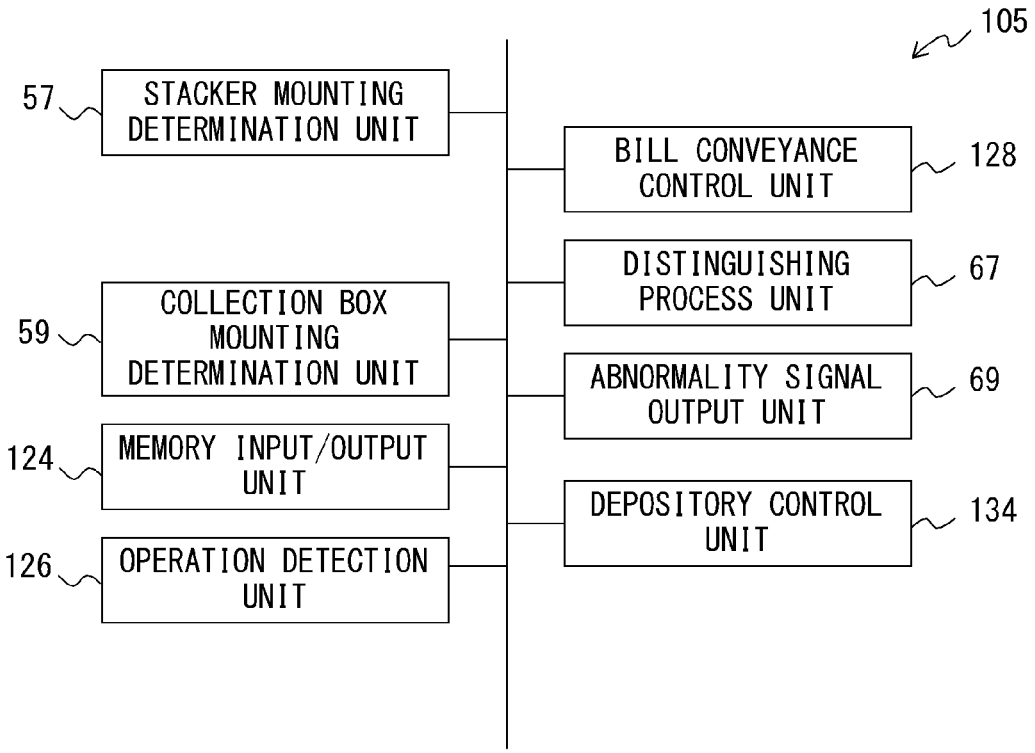
FIG. 7 is a block diagram representing functions of a control unit of the replenishing/collecting apparatus according to the first embodiment.

Next, explanation will be given for the configuration of a replenishing/collecting apparatus 100 according to the first embodiment by referring to FIGS. 5 through 7. FIG. 5 represents the configuration of the replenishing/collecting apparatus 100. FIG. 6 is a block diagram representing the configuration of the replenishing/collecting apparatus 100. FIG. 7 is a block diagram representing functions of a control unit 105.

As illustrated in FIGS. 5 and 6, the replenishing/collecting apparatus 100 replenishes the stacker 9 with bills, or collects bills from the stacker 9. In the replenishing/collecting apparatus 100, portions having similar configurations as in the money input/output apparatus are denoted by the same numerical symbols, and their explanations will be omitted. The replenishing/collecting apparatus 100 includes an operation unit 104, a depository 102, bill conveyance units 108 through 116, the bill distinguishing unit 7, stackers 9-1 through 9-8 (referred to also as stacker 9), stacker mount units 13-1 through 13-8 (referred to also as stacker mount unit 13), stacker detection units 29-1 through 29-8 (referred to also as stacker detection unit 29), a collection box 117, the collection box mount unit 51, the collection box detection unit 28, the abnormality report unit 53, and a storage unit 101, which are connected to the control unit 105 through the system bus 2.

The operation unit 104 is provided on, for example, the front plane of the replenishing/collecting apparatus 100, and has an input window (not shown) or the like for inputting instructions for replenishing the stacker 9 with bills and collecting bills from the stacker 9. The depository 102 is an accommodation unit for storing bills to be used for replenishing the stacker 9 with. The bill conveyance units 108 through 116 are paths along which a plurality of rollers (not shown) that can rotate in the forward and backward directions are provided for conveying bills to a prescribed direction by holding bills between themselves by utilizing friction with the bills, or the like. The bill conveyance units 108 through 116 are further provided with a motor (not shown) for driving at least part of these plurality of rollers so that bills can be conveyed between the depository 102, the stacker 9, and the collection box 117.

The stackers 9-1 through 9-8 are removably provided to the stacker mount units 13-1 through 13-8, respectively as indicated by arrows 10 in FIG. 5. The stackers 9-1 through 9-8 may be mounted on any stacker mount units, and have the same internal configurations as those of the stackers 9*a* through 9*d*. Also, the stackers 9-1 through 9-8 are provided with memory devices 11-1 through 11-8, respectively. The collection box 117 is an accommodation unit for storing bills collected from the stackers 9-1 through 9-13, includes a memory device 25, and is removably provided to the collection box mount unit 51. The collection box 117 is identical to the collection box 27 in configuration, and can be used as the collection box 27 of the money input/output apparatus 1.

The storage unit 101 is a memory device such as a ROM device, a RAM device, or the like for appropriately recording a control program of the replenishing/collecting apparatus 100, denominations corresponding to the stackers 9-1 through 9-8, data related to the conveyance of bills, data read from the memory devices 11 provided to the stackers 9-1 through 9-8, information generated accompanying processes by the control unit 105 such as distinguishing results, or the like.

Explanations will be given for functions of the control unit 105 by referring to FIG. 7. Members having the similar functions as those in the money input/output apparatus are denoted by the same numerical symbols, and there explanations thereof will be omitted. The control unit 105 has the functions of the stacker mounting determination unit 57, the collection box mounting determination unit 59, a memory input/output unit 124, an operation detection unit 126, a bill conveyance control unit 128, the distinguishing process unit 67, the abnormality signal output unit 69, and a depository control unit 134.

The memory input/output unit 124 reads and write data to and from the memory device 11 and the memory device 25 by referring to data stored in the storage unit 101, and stores read data in the storage unit 101. The operation detection unit 126 detects an operation made on the operation unit 104. The bill conveyance control unit 128 controls the movement of bills of the bill conveyance units 108 through 116 and the stacker 9 in accordance with an operation made on the operation unit 104, data read from the memory device 11 and the memory device 25, a control program stored in the storage unit 101, and the like. The depository control unit 134 controls the feeding out of bills from the depository 102 by controlling a conveyance mechanism (not show) in accordance with instructions from the operation unit 104. It is possible to replenish the depository 102 with bills from the outside as indicted by an arrow 103.

Figure 8:
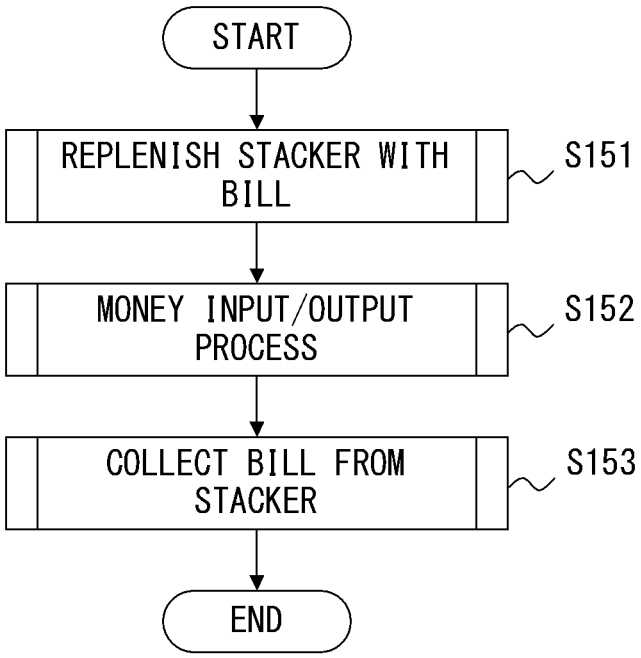
FIG. 8 is a flowchart explaining a method of running a money input/output apparatus according to the first embodiment.
Figure 9:
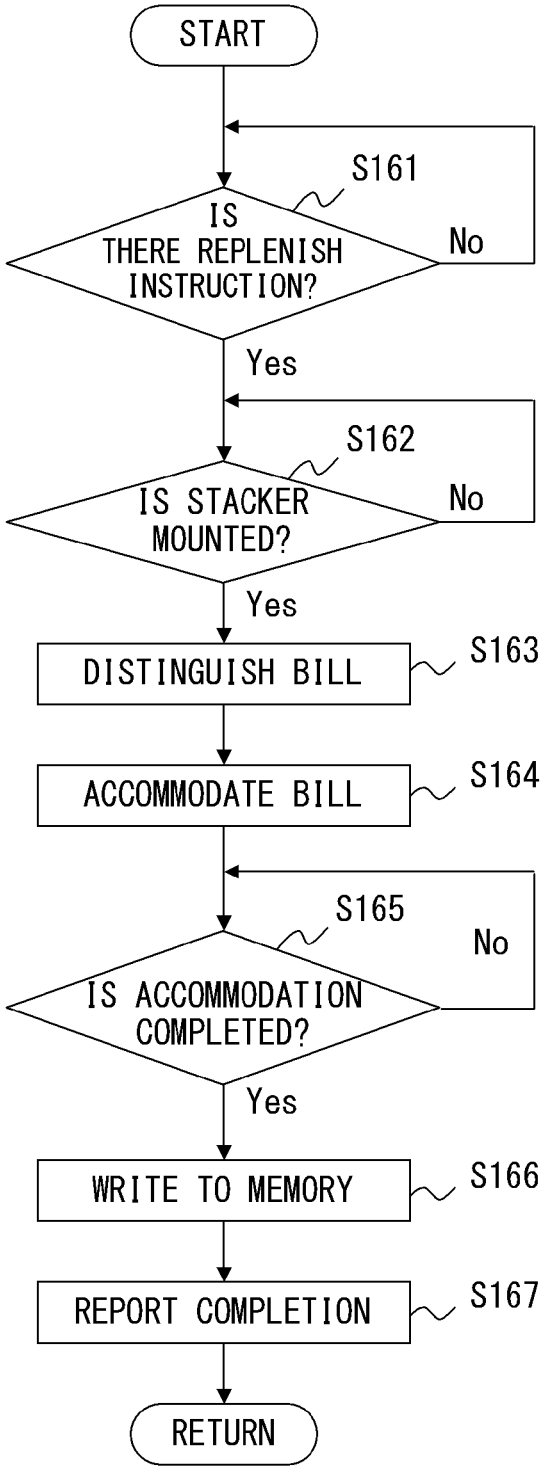
FIG. 9 is a flowchart explaining a bill replenishment process performed in the replenishing/collecting apparatus according to the first embodiment.
Figure 10:
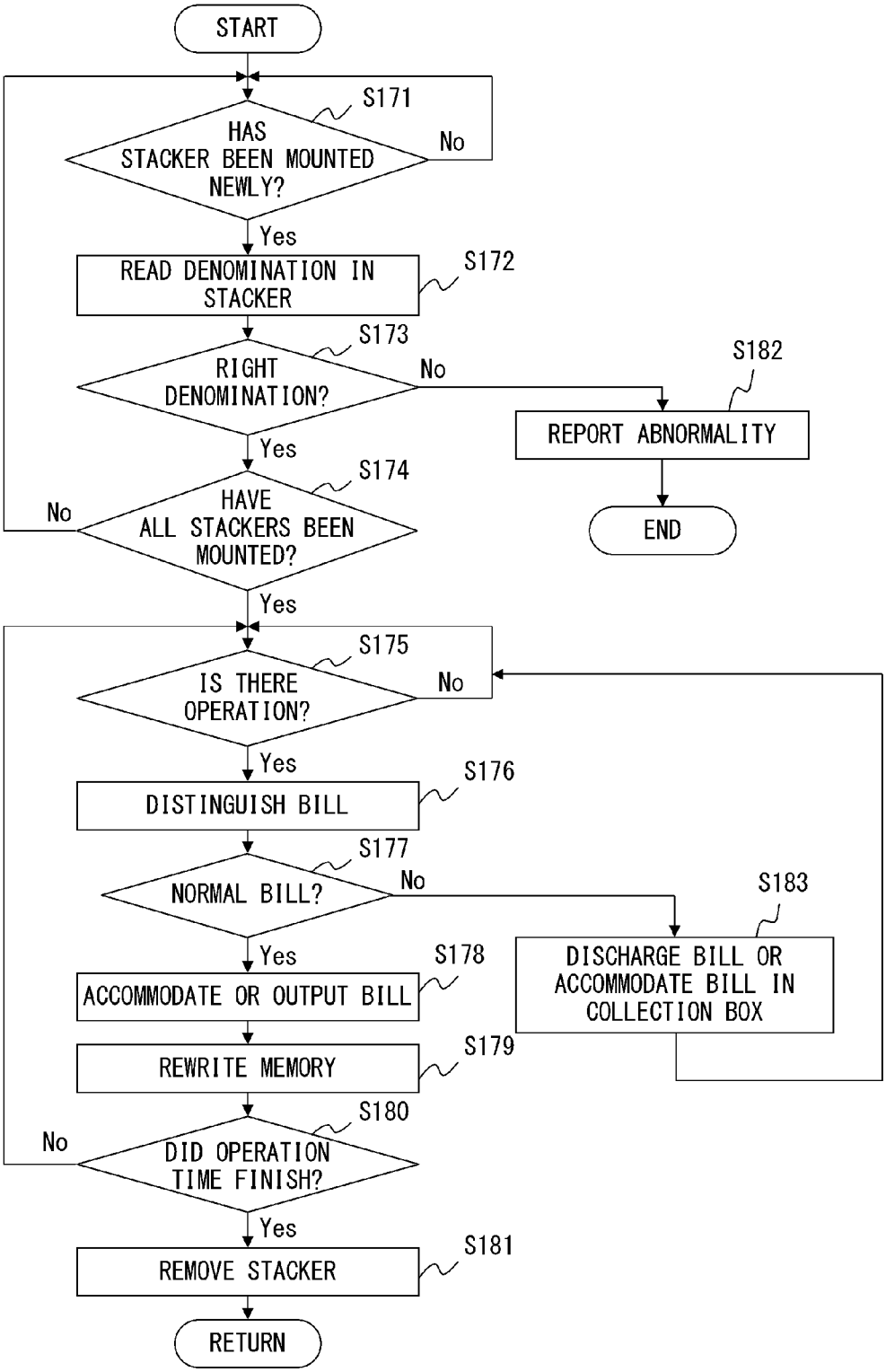
FIG. 10 is a flowchart explaining a money input/output process performed in the money input/output apparatus according to the first embodiment.
Figure 11:
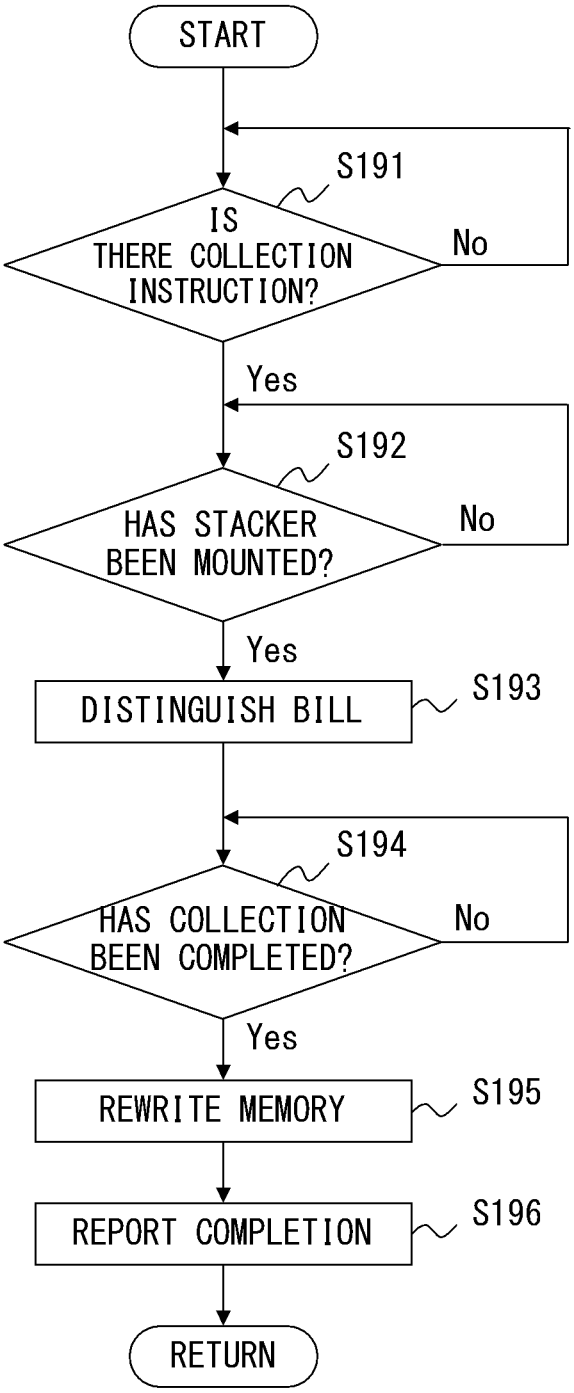
FIG. 11 is a flowchart explaining a bill collection process in the replenishing/collecting apparatus according to the first embodiment.

Next, explanations will be given for operations of the money input/output apparatus 1 and the replenishing/collecting apparatus 100 configured as described above by referring to FIGS. 8 through 11. FIG. 8 is a flowchart explaining a method of running the money input/output apparatus 1 according to the first embodiment. FIG. 9 is a flowchart explaining the bill replenishment process in the replenishing/collecting apparatus 100. FIG. 10 is a flowchart explaining a money input/output process in the money input/output apparatus 1. FIG. 11 is a flowchart explaining the bill collection process in the replenishing/collecting apparatus 100.

As illustrated in FIG. 8, the stacker 9 that can be mounted on and removed from both of the money input/output apparatus 1 and the replenishing/collecting apparatus 100 is replenished with bills in the replenishing/collecting apparatus 100 (S151). This process is usually performed in a backyard before the start of the services in which money is input and output by using the money input/output apparatus 1. After being removed from the replenishing/collecting apparatus 100, the stacker 9 is mounted on the money input/output apparatus 1, and the money input/output process is performed (S152). When the money input/output process is finished, and the stacker 9 has been removed from the money input/output apparatus 1, the stacker 9 is mounted back on the replenishing/collecting apparatus 100, and bills inside are collected (S153). The collection of bills is usually performed in the backyard after the money input/output service is finished.

Next, explanations will be given for the bill replenishment process in the replenishing/collecting apparatus 100 by referring to FIG. 9. As illustrated in FIG. 9, the replenishing/collecting apparatus 100 repeats detection until an replenishment instruction is input in the operation unit 104 (S161). In other words, the operation detection unit 126 of the control unit 105 monitors whether a signal based on operations for performing bill replenishment is input from the operation unit 104. While the operation detection unit 126 is performing this monitoring, information specifying, for example, at least one of the stackers 9-1 through 9-8 as a replenishment target, and the denomination and the number of bills used for the replenishment are input to the operation unit 104.

Next, it is detected whether or not the stacker 9 as a replenishment target for which a replenishment instruction has been input from the operation unit 104 has been mounted (S162). Specifically, the stacker mounting determination unit 57 continues monitoring (No in S162) until a signal indicating the mounting of the stacker 9 is detected from the stacker detection unit 29 corresponding to the stacker 9 to be replenished. When the stacker for which a replenishment instruction was input from the operation unit 104 has not been mounted, an error message or a message prompting the mounting of the stacker 9 may be displayed on the operation unit. When the mounting of the stacker 9 to be replenished is detected (Yes in S162), bills are fed out from the depository 102. Bills having been fed out are distinguished by the bill distinguishing unit 7 (S163). Specifically, the depository control unit 134 transmits a control signal to a conveyance mechanism (not shown) in response to the denomination and the number of the bills input in the operation unit 104 in order to feed out bills to the bill conveyance unit 108. The bill distinguishing unit 7 outputs a signal responding to the denomination, the authenticity, and the like of the bills by using a distinguishing mechanism (not shown) having, for example, an optical sensor included inside, and the distinguishing process unit 67 distinguishes the bills (S163). Bills that are suspicious about the authenticity or are inappropriate to be used (bills subjected to breakage, damage, stain, or the like) are conveyed to the collection box 117 by, for example, a bill conveyance unit (not shown) running between the bill conveyance unit 116 and the bill distinguishing unit 7.

Bills distinguished to be appropriate to be used are accommodated sequentially in the replenishment target stacker 9 (S164). The control unit 105 performs monitoring (S165) until the accommodation is completed by the depository control unit 134, the bill conveyance control unit 128, the distinguishing process unit 67, etc. When the termination of the accommodation is detected, the memory input/output unit 124 makes the memory device 11 of the stacker 9 that has been replenished with bills store the denomination and the number of bills used for the replenishment (S166). The control unit 105 reports the completion (S167), for example, by displaying the completion on a display unit (not shown) of the operation unit 104 (S167) so as to terminate the replenishment process. It is also possible to store bills of a plurality of denominations in the depository 102 in the above replenishment process. It is also possible to employ a configuration in which data specifying what denominations are to be accommodated in which of the stackers 9-1 through 9-8 is beforehand stored in, for example, the storage unit 101 so that the bill conveyance control unit 128 switches the stackers 9 as the conveyance destinations in response to the stored data and the distinguishing results by the bill distinguishing unit 7.

Next, explanations will be given for the money input/output process performed by the money input/output apparatus 1 by referring to FIG. 10. Note that the stacker 9 is removed to be mounted on the money input/output apparatus 1 when replenishment of the replenishing/collecting apparatus 100 has been finished. As illustrated in FIG. 10, the money input/output apparatus 1 performs monitoring (No S171) until the stacker 9 is mounted newly. Specifically, the stacker mounting determination unit 57 of the control unit 5 performs monitoring until a signal is transmitted indicating the mounting of the stacker 9 from one of the stacker detection units 29*a* through 29*d*.

When the stacker 9 has been determined to have been mounted (Yes in S171), accommodation information including the denomination and the number of bills accommodated in the stacker 9 is read from the memory of the mounted stacker 9 (S172). Specifically, the memory input/output unit 61 accesses the memory device 11, and reads the stored accommodation information such as the denomination, the number, and the like of the bills so as to store the information in the storage unit 55. The storage unit 55 has beforehand stored which of the stacker mount units 13 is to receive the stackers 9 having stored what denominations in an associated manner. The bill conveyance control unit 65 determines whether or not the denomination obtained from the memory device 11 is identical to the right denomination that has beforehand been stored in the storage unit 55 (S173). When it is not identical, (No in S173), an abnormality signal is transmitted from the abnormality signal output unit 69, and an abnormality is reported in the abnormality report unit 53 (S182). When it is the right denomination (Yes in S173), it is determined whether or not the stackers 9*a* through 9*d* are mounted on the stacker mount units 13*a* through 13*d* (S174). When the stacker mount unit 13 on which the stacker has not been mounted exists, the process returns to S171. It is also possible to employ a configuration in which information on the stacker that has to be mounted is stored in the storage unit 55 via the operation unit 4 or the like, and the process proceeds to the next step (S175) even if not all the stackers have been mounted.

When the stackers 9 have been mounted on all the stacker mount units 13 (Yes in S174), the operation detection unit 63 starts detection of operations input from the operation unit 4, and performs monitoring (No in S175) until an operation is input. When the operation detection unit 63 has detected an operation from the operation unit 4 (Yes in S175), information corresponding to the detected operation is stored in the storage unit 55. The bill conveyance units 31 through 49 perform conveyance in response to the operation from the operation unit 4 while the distinguishing process unit 67 distinguishes bills to be input or output that have been conveyed in accordance with a signal from the bill distinguishing unit 7 (S176) during the conveyance. Specifically, the distinguishing process unit 67 determines whether or not they are normal i.e., whether they are bills not appropriate to for outputting such as bills that are suspicious about the authenticity, that are subjected to breakage, damage, stain, or the like (S177). When the bill are determined to be not normal (No in S177), the bills that were input from the money input unit 15 are discharged from the money output unit 17, and the bills that were fed out from the stacker 9 are accommodated in the collection box 27 (S183). When bills are determined to be normal, the bills are collected or output (S178). When they are collected or output, the distinguishing process unit 67 stores information related to distinguishment of the bills in the storage unit 55. Note that operations after the operation detection unit 63 detected operations on the operation unit 4 and before the collection or the output of bills is completed (S175 through S178) will be explained later in detail.

The memory input/output unit 61 calculates the denominations and the numbers of bills accommodated in the respective stackers 9*a* through 9*d* and the collection box 27 on the basis of information stored in the memory device 11 in the storage unit 55 and information stored by, for example, the distinguishing process unit 67, and stores in the storage unit 55 the denominations and the numbers in an associated manner. When the number of bills in one of the stackers 9*a* through 9*d* or in the collection box 27 has changed, information in the corresponding memory device 11 or the memory device 25 is rewritten (S179). It is also possible for the memory input/output unit 61 to write prescribed information to the memory device 11 and the memory device 25 on an as-needed basis. The above operations are repeated (No in S180) until the operation time of the money input/output apparatus 1 finishes, and when the operation time has finished, the stacker 9 is removed (S181), and the process terminates.

Explanations will now be given for operations in steps S175 through S178 respectively in response to types of money input/output processes. It is now assumed that 10000 yen bills, 5000 yen bills, and 1000 yen bills are stored in the stackers 9*a* through 9*c*, respectively. The explanations assume a case where the stacker 9*d* is in a state that it can accommodate at least a prescribed number of bills when the money input/output apparatus 1 starts its service, and the stacker 9*d* is used as a temporary depository.

As the first example, a case will be explained where bills have been inserted into the money input unit 15. When the operation detection unit 63 has detected the insertion of bills into the money input unit 15 of the operation unit 4, the money input unit 15 feeds the bills to the bill conveyance unit 31 by using a mechanism (not shown) in a one-by-one manner. The bills are conveyed through the bill conveyance units 31, 32, and 33 under the control of the bill conveyance control unit 65, and pass through the bill distinguishing unit 7. When bills that have been conveyed are determined by the distinguishing process unit 67 to be authentic 1000 yen bills that can be used as, for example, bills to be output, bill conveyance units 35, 36, 38, and 41 accommodates them in the stacker 9*c*. In the stacker 9*c*, bills are rolled up on the drum 88 by being sandwiched by the tape 96 and tape 98 as illustrated in FIG. 4.

When bills are suspicious about authenticity, or are determined to be inappropriate for outputting such as when they are subjected to breakage, damage, stain, or the like, such bills are temporarily accommodated in the stacker 9*d* as a temporary depository through the bill conveyance units 35, 36, and 39. When bills are suspicious about authenticity, the bill conveyance control unit 65 feeds out bills from the stacker 9*d* again. Specifically, in the stacker 9*d*, the bill conveyance control unit 65 controls the stepping motor 79 so that bills are rolled up on the drum 88 by being sandwiched by the tape 96 and the tape 98 to be accommodated as illustrated in FIG. 4. Thereafter, the drum rotates in the reverse direction so that bills are fed out from between the tension roller 91 and the rotation transmission roller 92. Then, the bills are discharged from the money output unit 17 through the bill conveyance units 39, 36, 35, 33, and 47. When they have been determined to be bills that are inappropriate for reusing or when the stacker 9*c* has no more space to accommodate bills, the bills are accommodated in the collection box 27 through the bill conveyance units 39, 35, and 37 after the completion of process of inputting bills.

When the operation unit 4 has received a cancelling operation before the confirmation of inputting money (during temporary accommodation of input bills), the bill conveyance control unit 65 feeds out as many bills as input bills from the stacker 9*c* or 9*d* that has accommodated the input bills, and discharges them from the money output unit 17 through the bill conveyance units 38, 36, 35, 33, and 47, and the like.

Explanations will be given for a case a where bills are output as change from the money output unit 17 as a second example. It is assumed that the bill conveyance control unit 65 has given a money output instruction to the bill conveyance unit 49 of, for example, the stacker 9*b* when change has to be output in the above money input/output processor the like. In the stacker 9*b*, the drum 88 rotates in the reverse direction so that as many bills as necessary are fed out in accordance with the instruction from the bill conveyance control unit 65, and the bills are discharged from the money output unit 17 through the bill conveyance units 43, 40, 38, 36, 35, 33, and 47 sequentially. When this process is performed, the bill distinguishing unit 7 performs simple distinguishment such as determination of the length, or the like. It is desirable that bills that have been determined to be inappropriate for outputting as a distinguishment result be accommodated in the collection box 27 through, for example, the bill conveyance units 42, 40, 38, 36, and 37 and other bill conveyance units (not shown) connecting the bill conveyance units 33 and 42.

Explanations will be given for a case where bills are collected in the money input/output apparatus 1 as a third example. When an instruction to collect bills from one of the stackers 9 has been input through the operation unit 4, the bill conveyance control unit 65 makes the specified stacker 9 sequentially feed out bills that have been accommodated, and conveys the bills to the collection box 27 through the bill conveyance units 36 through 45 so as to accommodate them in it. When this operation is performed, the memory input/output unit 61 makes the memory device 25 store the denominations, the numbers, and the categories of accommodated bills in an associated manner. It is also possible for the memory input/output unit 61 to write to the memory device 25 prescribed information on an as-needed basis. It is also possible to obtain from the memory device 11 in the stacker 9 information on bills to be stored in the memory device 25.

As another example, it is also possible to provide the stacker 9 dedicated to replenishment at, for example, a position that allows bills to be conveyed into it from a position above the bill distinguishing unit 7 of the bill conveyance unit 33 on the left side of the outside of the money input/output apparatus 1 in FIG. 1 so as to replenish the stackers 9*a* through 9*d* with bills through the bill conveyance units 33, 35, 36, 39, 41, 43, and 45, and the like.

Next, explanations will be given for a process of collecting bills performed by the replenishing/collecting apparatus 100 by referring to FIG. 11. FIG. 11 is a flowchart explaining a process of collecting bills performed by the replenishing/collecting apparatus 100. When the replenishing/collecting apparatus 100 performs the collection, the stackers 9*a* through 9*d* are removed from the money input/output apparatus 1, and one of the stacker mount units 13-1 through 13-8 of the replenishing/collecting apparatus 100 is mounted. As illustrated in FIG. 11, the operation detection unit 126 continues monitoring until an instruction to collect bills is given to the operation unit 104 (No in S191). When the operation detection unit 126 has detected a collection instruction, the stacker mounting determination unit 57 continues monitoring until the collection target stacker 9 from which the collection of bills has been instructed is mounted, while the collection box mounting determination unit 59 continues monitoring until the collection box 117 is mounted (No in S192).

When the stacker mounting determination unit 57 has determined the mounting of the collection target stacker 9 and the collection box mounting determination unit 59 has determined the mounting of the collection box 117 (Yes in S192), the drum 88 rotates in the reverse direction in the collection target stacker 9 so that bills are fed out. In FIG. 5, when the collection target stacker is, for example, the stacker 9-6, bills are conveyed to the bill distinguishing unit 7 through the bill conveyance units 113 and 115, and the distinguishing process unit 67 distinguishes the bills in accordance with signals corresponding to the denominations, the authenticity, and the like output from the bill distinguishing unit 7 (S193). The distinguishing process unit 67 stores in the storage unit 101 the distinguishing results such as the denominations, the numbers, the authenticity, or the like of the bills.

The control unit 105 continues monitoring until the collection by the bill conveyance control unit 128, the distinguishing process unit 67, and the like is terminated (No in S194). When the control unit 105 has detected the termination of the collection (Yes in S194), the memory input/output unit 124 resets the memory device 11 of the stacker 9 from which bills were collected. The memory input/output unit 124 refers to the distinguishing results stored in the storage unit 101, and stores in the memory device 25 the denominations, the numbers, and the like of the collected bills (S195). The control unit 105 reports the completion, for example, by displaying the fact of the completion on a display unit (not shown) in the operation unit 104 (S196), and the collection process is terminated.

As described above, the stacker 9, which is able to be attached to and removed from both of the money input/output apparatus 1 and the replenishing/collecting apparatus 100 according to the first embodiment accommodates bills by making the drum 88 roll up them while they are sandwiched by two pieces of the tape 96 and the tape 98. Also, it is configured to feed out bills sandwiched by the pieces of tape to the outside by making the drum 88 rotate in the reverse direction. Also, accommodation information such as the denominations, the numbers, and the like of bills accommodated inside is stored in the memory device 11. The stacker 9 is replenished with bills in the replenishing/collecting apparatus 100, and the accommodation information of the accommodated bills is stored in the memory device 11. After being removed from the replenishing/collecting apparatus 100, the stacker 9 is mounted on the money input/output apparatus 1, and the money input/output process is performed. When the money input/output process is terminated and the stacker 9 is removed from the money input/output apparatus 1, the stacker 9 is mounted on the replenishing/collecting apparatus 100 again so that bills in it are collected. When this process is performed, the memory device 11 is reset to the initial state.

Note that, in the money input/output apparatus 1, the memory 11 is an example of a first storage unit according to the present invention, the stacker 9 is an example of a bill accommodation unit, the stacker mount unit 13 is an example of a mount unit, the stacker detection unit 29 is an example of a detection unit, the memory input/output unit 61 is an example of a reading unit and an updating unit, the storage unit 55 is an example of a second storage unit, the bill conveyance control unit 65 is an example of an accommodation distinguishing unit, the operation unit 4 is an example of an instruction input unit, and each of the bill conveyance units 31 through 49 is an example of a conveying unit.

Also, in the replenishing/collecting apparatus 100, the operation detection unit 126 is an example of a replenishment instruction obtainment unit according to the present invention, the depository control unit 134 and the bill conveyance control unit 128 are examples of a replenishment unit and a collection unit, and the memory input/output unit 124 is an example of a recording unit.

As described above, according to the money input/output apparatus and the replenishing/collecting apparatus according to the first embodiment, a removable stacker that can be used for a plurality of denominations of bills can be installed without mechanical adjustment or the like. In other words, a stacker that can accommodate and feed out bills regardless of differences in bill sizes and influences of friction between bills can be provided. For this, erroneous mounting on the money input/output apparatus 1 can be detected by providing the memory devices 11 for storing accommodation information including the denominations and the numbers of accommodated bills. Also, by making the money input/output apparatus 1 and the replenishing/collecting apparatus 100 read information from the memory devices 11, accommodation information on bills accommodated inside can be read, and thereby the timing of replenishment and collection can be made more accurate.

Also, according to the stacker 9, the area of the base of the accommodation unit can be smaller than the size of bills when it is accommodating bills contrary to a case where bills are accommodated in a stacked manner, and thereby the money input/output apparatus 1 and the replenishing/collecting apparatus 100 can be more compact. Also, the stacker 9 can be a removable stacker that can prevent double feed during feeding out of bills.

Further, because the stacker 9 is removably provided to the money input/output apparatus 1, the replenishing/collecting apparatus 100 can be replenished with bills only by mounting one of the stackers 9 that has been replenished with bills by the replenishing/collecting apparatus 100. Collection can also be performed by the replenishing/collecting apparatus 100 by removing the stacker 9. Accordingly, bills are accommodated or fed out sequentially by the stacker 9, however, operations before the service of the money input/output apparatus 1 starts and after the service finishes can be performed in a short time period. Further, even when the apparatus has to be replenished with bills during the service hours, the replenishment can be completed only by removing and mounting cassettes, thereby preventing deterioration in the quality of customer services.

In the replenishing/collecting apparatus 100, the plurality of stackers 9 can be replenished with bills at the same time by distinguishment performed by the bill distinguishing unit 7 with bills of various denominations being accommodated in the depository 102, making it possible to increase operation efficiency. Also, the stacker 9 can be used for a plurality of denominations, minimizing the number of stackers 9 that have to be prepared so as to attain costs. Further, the collection box 117 and the collection box 27 can be used in the same manner in the money input/output apparatus 1, making it possible to reduce costs further.

Second Embodiment

Next, explanations will be given for a money input/output process performed by the money input/output apparatus according to a second embodiment by referring to FIG. 12. The configuration of the money input/output apparatus is the same as that of the money input/output apparatus 1 according to the first embodiment, and thus explanations thereof will be omitted. Also, S201 and S202 in FIG. 12 are identical to S171 and S172 in FIG. 8, and S204 through S211, and S213 in FIG. 12 are identical to S174 through S181, and S183 in FIG. 8, and thus, detailed explanations thereof will be omitted.

Figure 12:
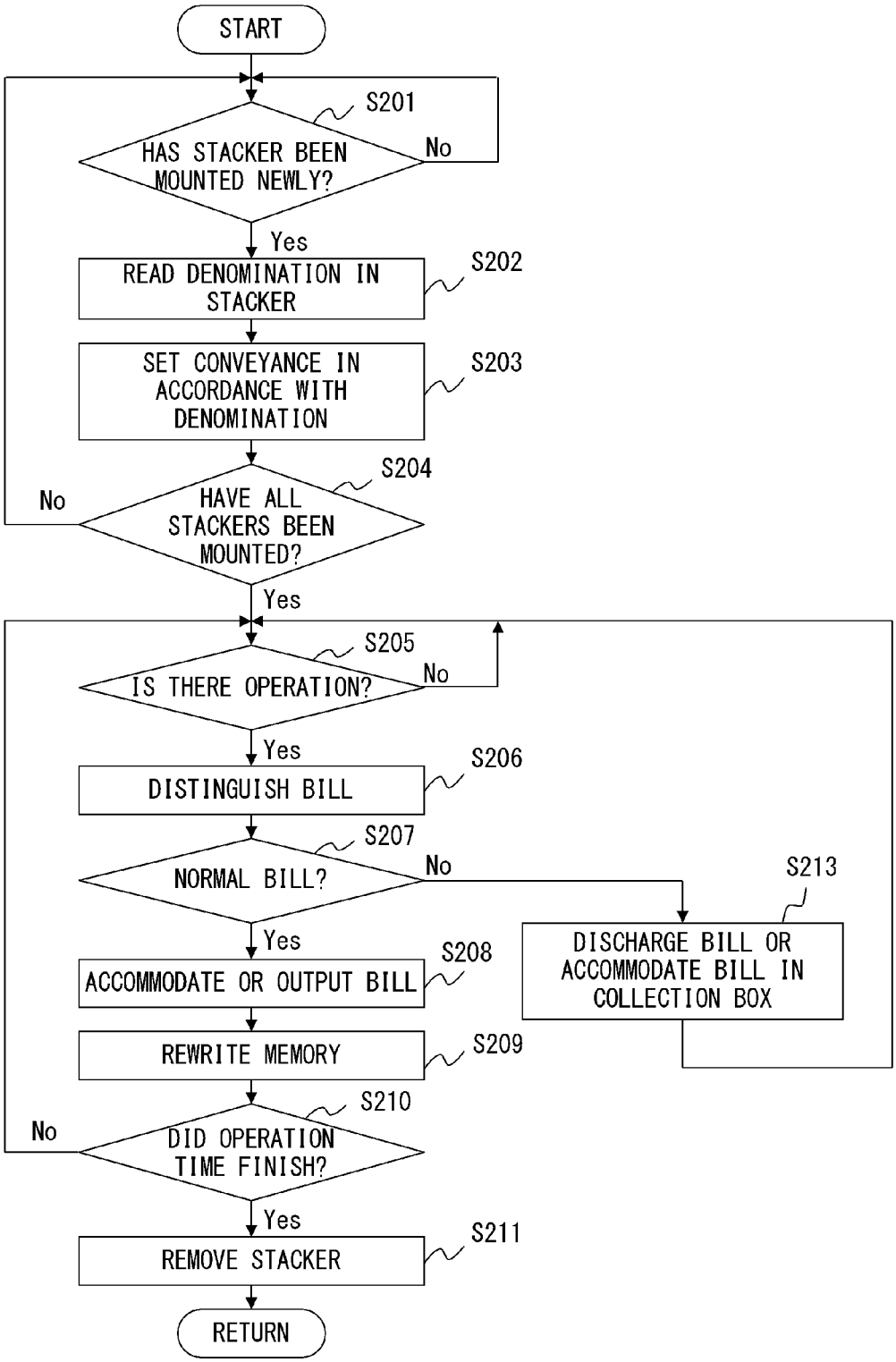
FIG. 12 is a flowchart explaining a money input/output process in a money input/output apparatus according to a second embodiment.

FIG. 12 is a flowchart explaining the money input/output process of the money input/output apparatus according to the second embodiment. In the money input/output apparatus 1 according to the first embodiment, the denominations of bills accommodated in the stacker 9 mounted on each of the stacker mount unit 13 is set, while the second embodiment controls the conveyance of bills in accordance with the denominations read from the memory device 11. Specifically, as illustrated in FIG. 12, when the memory input/output unit 61 has read denomination from the accommodation information in the memory device 11, the memory input/output unit 61 stores in the storage unit 55 the read denominations and identification information of the stacker mount units 13*a* through 13*d* in an associated manner. The bill conveyance control unit 65 sets the conveyance in accordance with the denominations stored in the storage unit 55 and the information of the stacker mount units 13*a* through 13*d* (S203). When denominations have been set for all the stacker mount units 13, the process proceeds to S204. Note that the abnormality report unit 53 may report abnormalities of, for example, the bill conveyance units 31 through 49 in the present embodiment.

As described above, according to the money input/output apparatus 1 of the second embodiment, the denomination of bills stored in the memory device 11 of the stacker 9 can be set as the denomination of bills that are accommodated or fed out by the stacker mount unit 13 by the position of the stacker mount unit 13 on which the stacker 9 is mounted. Accordingly, the stacker mount unit 13 on which the stacker 9 is mounted is not limited, making it possible to improve the usability by, for example, using it as a bill input/output machine for different currencies.

Note that the present embodiment is not limited by the above described embodiments, and various configurations or embodiments can be adopted without departing from the spirit of the present invention. For example, the configuration of the stackers 9 is not limited to the above, and any configurations can be used for stackers of the present invention as long as they can accommodate and feed out different sized bills. Information in the memory devices 11 and 25 is not limited to the above, and can include other elements. Also, the configurations of the money input/output apparatus 1 and the replenishing/collecting apparatus 100 are not limited to the above, and any configurations causing similar effects are within the scope of the present invention.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A money input/output apparatus that inputs and outputs a bill, comprising:

at least one removable bill accommodation unit of a same configuration that can accommodate one denomination of a bill selected from a plurality of denominations, includes a first memory unit storing accommodation information including a denomination of an accommodated bill, and accommodates and discharges a bill;

a plurality of mount units on which any one of the bill accommodation units of the same configuration is mounted respectively regardless of the denomination of the accommodated bill;

a detection unit that detects whether or not the bill accommodation unit has been mounted on the mount unit;

a second memory unit that stores an identification information of the mount unit and the denomination of the bill to be accommodated in the bill accommodation unit mounted on the mount unit in an associated manner;

an instruction receiving unit that receives an instruction to input or output the bill;

a conveyance unit that conveys the bill;

a control unit that reads the denomination of the bill from the first memory unit and determines whether or not the read denomination of the bill corresponds to the denomination stored in the second memory unit in association with the identification information of the mount unit on which mounting of the bill accommodation unit has been detected when the detection unit has detected that the bill accommodation unit has been mounted on the mount unit, starts reception of an instruction to input or output the bill from the instruction receiving unit and makes the conveyance unit convey the bill in accordance with the instruction when the denominations have been determined to correspond.

2. The money input/output apparatus according to claim 1, wherein:

the accommodation information includes information representing a number of the bills; and the money input/output apparatus further comprises:

a bill distinguishing unit that distinguishes a denomination and a number of the bills input or output in accordance with the instruction to input or output the bill; and the control unit further stores in the second memory unit a distinguishing result of the denomination and the number of the bills input or output in accordance with the instruction to input or output the bill by the bill distinguishing unit, and updates information representing the number of bills in accommodation information stored in the first memory unit in accordance with the distinguishing result each time one operation of the inputting or outputting a bill in accordance with the instruction that the instruction receiving unit received is completed.

3. The money input/output apparatus according to claim 1, wherein:

the bill accommodation unit is configured to be able to accommodate and discharge a bill by making the bill rolled up on a rotatable body that can rotate in forward and backward directions by sandwiching the bill between two tape members.

4. A money input/output apparatus that inputs and outputs a bill, comprising:

a removable bill accommodation unit that can accommodate one denomination selected from a plurality of denominations of a bill, includes a first memory unit storing accommodation information including a denomination of an accommodated bill, and accommodates and discharges a bill;

a mount unit on which the bill accommodation unit is mounted;

a detection unit that detects whether or not the bill accommodation unit has been mounted on the mount unit;

a second memory unit that stores the denomination read from the first memory unit and an identification information of the mount unit in an associated manner when the bill accommodation unit has been mounted on the mount unit;

an instruction receiving unit that receives an instruction to input or output the bill;

a conveyance unit that conveys the bill;

a control unit that reads the denomination of the bill from the first memory unit and stores the read denomination and an identification information of the mount unit in the second memory unit in an associated manner when the detection unit has detected that the bill accommodation unit has been mounted on the mount unit, and starts reception of an instruction to input or output the bill by the instruction reception unit when the denomination and the identification information of the mount unit have been stored in the second memory unit in an associated manner, and makes the conveyance unit convey the bill in accordance with information stored in the second memory unit and the received instruction to input or output the bill.

5. The money input/output apparatus according to claim 4, wherein:

the accommodation information includes the number of the bills, and the control unit further distinguishes the denomination and the number of the bills input or output in accordance with the instruction to input or output the bill, stores a distinguishing result in the second memory unit, and updates information representing the number of bills in the accommodation information stored in the first memory unit in accordance with the distinguishing result each time one operation of the inputting or outputting a bill in accordance with the received instruction is completed.

6. The money input/output apparatus according to claim 4, wherein:

the bill accommodation unit is configured to be able to accommodate and discharge a bill by making the bill rolled up on a rotatable body that can rotate in forward and backward directions by sandwiching the bill between two tape members.

7. A bill replenishing/collecting apparatus, comprising:

a removable bill accommodation unit that can accommodate denomination selected from a plurality of denominations of a bill, includes a first memory unit storing accommodation information including a denomination and a number of an accommodated bill, and accommodates and discharges a bill;

a mount unit on which the bill accommodation unit is mounted;

a detection unit that detects whether or not the bill accommodation unit has been mounted on the mount unit;

a replenishment instruction obtainment unit that obtains a replenishment instruction including a denomination and a number of bills with which the bill accommodation unit is replenished;

a replenishment unit that replenishes the bill accommodation unit with bills in accordance with the replenishment instruction; and a control unit that makes the replenishment unit replenish the bill accommodation unit with a bill in accordance with the replenishment instruction obtained by the replenishment instruction obtainment unit when the detection unit has detected that the bill accommodation unit has been mounted, determines a denomination and a number of bills of replenishment, and records the accommodation information in the first memory unit in accordance with the determined denomination and number of the bill.

8. The bill replenishing/collecting apparatus according to claim 7, further comprising:

a collection unit that collects bills from the bill accommodation unit when the detection unit has detected the mounting of the bill accommodation unit.

9. The bill replenishing/collecting apparatus according to claim 7, wherein:

the bill accommodation unit is configured to be able to accommodate and discharge a bill by making the bill rolled up on a rotatable body that can rotate in forward and backward directions by sandwiching the bill between two tape members.

10. A method of running a money input/output apparatus that inputs and outputs a bill, comprising:

a detecting step in which a detection unit provided in the money input/output apparatus detects whether or not a bill accommodation unit that can accommodate one denomination selected from a plurality of denominations of a bill, includes a first memory unit storing accommodation information including a denomination of an accommodated bill, can be mounted on and removed from a mount unit included in the money input/output apparatus, and accommodates and discharges a bill;

a reading step of reading a denomination of the bill from the first memory unit;

an accommodation unit determination step of determining whether or not the denomination read in the reading step corresponds to a denomination of a bill stored in a second memory unit in the input/output apparatus in association with an identification information of the mount unit on which the mounting of the bill accommodation unit has been detected;

an instruction receiving step of starting reception of an instruction to input or output the bill when the denominations have been determined to correspond in the accommodation unit determination step; and a conveyance step of conveying the bill in accordance with the instruction.

* * * * *